United States Patent [19]

Mendez

[11] Patent Number: 4,783,944

[45] Date of Patent: Nov. 15, 1988

[54] BARREL ROOF TILE

[76] Inventor: Fernando Mendez, 10370 N.W. 135 St., Hialeah Gardens, Fla. 33016

[21] Appl. No.: 879,046

[22] Filed: Jun. 26, 1986

Related U.S. Application Data

[63] Continuation-in-part of Ser. No. 754,608, Jul. 12, 1985, Pat. No. 4,606,164.

[51] Int. Cl.[4] ..... E04D 1/04

[52] U.S. Cl. ..... 52/536; 52/518

[58] Field of Search ..... 52/536, 539, 595, 518; D25/80

[56] References Cited

U.S. PATENT DOCUMENTS

| | | | |
|---|---|---|---|
| D282,288 | 1/1986 | Bates | D25/80 |
| 4,262,466 | 4/1981 | Roe | 52/536 X |
| 4,372,090 | 2/1983 | Shichijo | 52/518 X |
| 4,606,164 | 8/1986 | Mendez | 52/536 |

FOREIGN PATENT DOCUMENTS

| | | | |
|---|---|---|---|
| 16590 | 5/1929 | Australia | 52/536 |
| 2558216 | 6/1977 | Fed. Rep. of Germany | 52/536 |
| 1376053 | 9/1964 | France | 52/536 |

*Primary Examiner*—J. Karl Bell

*Attorney, Agent, or Firm*—J. Sanchelima

[57] ABSTRACT

A roof tile with longitudinal flat and curved or barrel-shape sections and a wedge member mounted to the underside of the flat section, along its entire length with the exception of a portion at the front of the tile. The space defined is sufficient to cooperatively and snuggly house a part of the rear of a tile installed in front. This provides a longitudinal resting area on the flat section of the tile. A longitudinal flange member extends upwardly and outwardly from the edge of the side wall of the flat section of the tile so that it interlockingly engages with horizontally abutting tiles.

2 Claims, 2 Drawing Sheets

BARREL ROOF TILE

RELATED APPLICATION

The present application is a continuation-in-part of U.S. patent application Ser. No. 754,608 filed on July 12, 1985, now U.S. Pat. No. 4,606,164, and it is hereby incorporated by reference.

BACKGROUND OF THE INVENTION

1. Field of the Invention

The present invention relates to roof tiles, and more particularly, to barrel roof tiles.

2. Description of the Related Art

The barrel design for roof tiles is quite attractive and popular. However, when installed, the roof tiles overlap each other and become even more sensitive to the weight of persons walking over them, such as roof repair persons. It is not unusual for roof tiles to become brittle from the exposure to the elements thereby making them more susceptible to the weight of the repair persons.

SUMMARY OF THE INVENTION

It is one of the main objects of the present invention to provide a roof tile with a barrel shape and a leveled support on its underside that supports the weight of roofers walking over it.

Another object of this invention is to provide a tile that is volumetric efficient, sturdy and or low weight.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
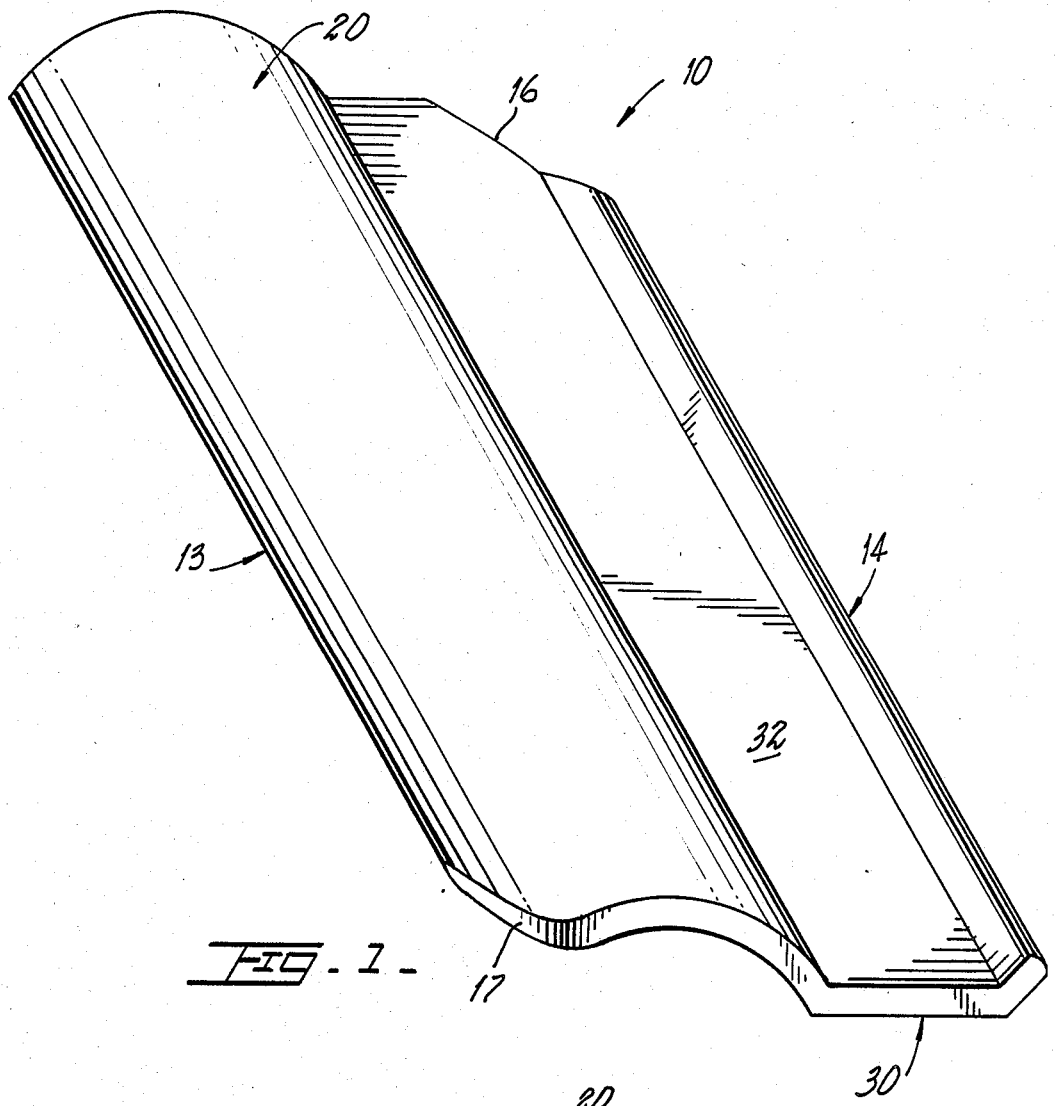
FIG. 1 represents a view in perspective from the top of the barrel roof tile.

Referring now to FIG. 1, it can be observed that the invention is generally referred to with numeral 10, and it comprises of two longitudinal sections: barrel or curved section 20 and flat section 30. Basically, tile 10 has a rectangular projected shape with front 11, rear 12, and lateral walls 13 and 14.

Figure 2:
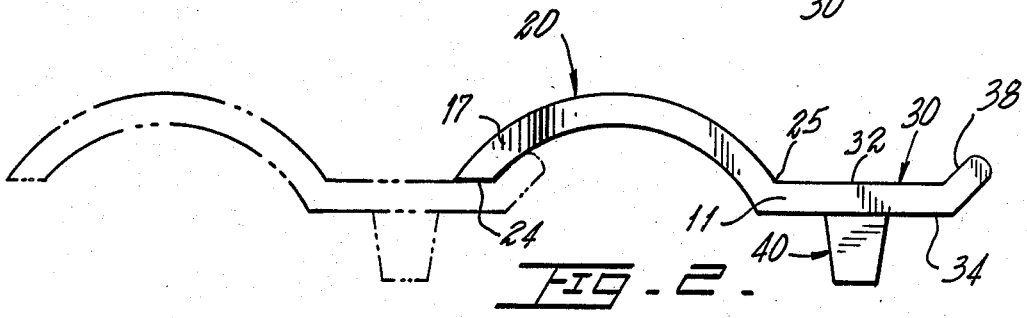
FIG. 2 shows a rear view of two horizontally abutting barrel roof tiles.

Barrel section 20 is integrally built on and attached to flat section 30 at junction 25, as seen in FIGS. 1 and 2. Barrel section 20 ends at surface 24 at a horizontal level that substantially matches the plane defined by surface 32 on the upperside of flat section 30 so that surface 24 may rest on the upper surface 32 of flat section 30 of an adjacent tile, as shown in FIG. 2. Lateral flange 38 is positioned at approximately 45° with respect to surface 32. It cooperates with the underside of the outer end of curved section 20 to provide an interlocking engagement.

Cut off sections 16 and 17 are provided to facilitate the installation of tiles 10 in continuous abutting horizontal and vertical like tiles.

Figure 3:
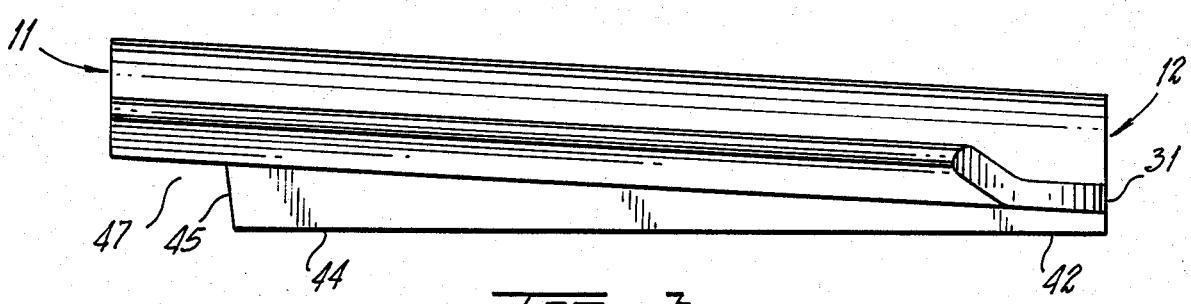
FIG. 3 is an elevational side view of the barrel roof tile.
Figures 4, 5:
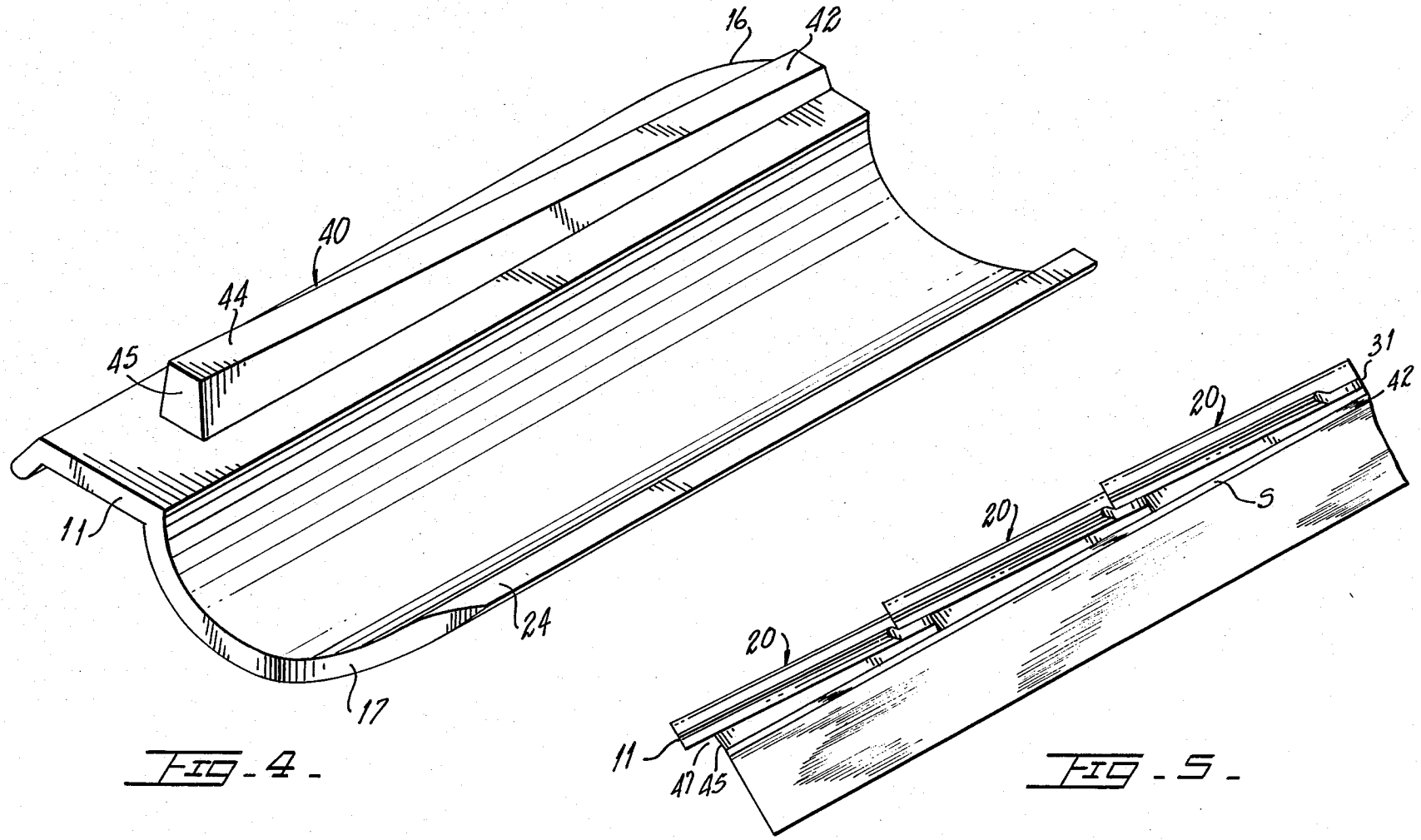
FIG. 4 shows a tile upside down.
FIG. 5 is a side elevational view illustrating three vertically abutting tiles resting on roof sheathing 5.

Underside 34 of flat section 30 includes wedge member 40, as shown in FIGS. 2 and 3. Wedge member 40 extends longitudinally along almost the entire length of flat section 30, preferably. The thinnest end 42 of wedge member 40 ends, preferably leveled with the rear wall 31 of flat section 30. The thicker or tallest end 44 extends to the front and drops down forming front wall 45 of wedge member 40, as it can be appreciated from FIG. 4. A compartment or space 47 is thereby defined that houses the rear portion of a vertically abutting tile in front of the roof tile being described, when installed on sheating S on a roof in rows of contiguous interlocking tiles, as it can be seen in FIG. 5.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A roof tile having front, rear and two lateral walls, for cooperative interlocking arrangement in horizontal and vertical rows of said roof tile comprising:

A. a longitudinal flat section having an underside and an upperside wherein said flat section includes a longitudinal flange member along the end defining the other lateral wall of said tile and interlockingly engages with the edge of said side wall on said curved section;

B. a longitudinal curved section attached to said flat section longitudinally wherein said curved section defines one of said lateral walls and terminates with a horizontal surface that is leveled with the upperside of said flat section so that when said roof tile is placed next to another tile said horizontal surface rests on said upperside thereby providing a longitudinal resting area;

C. a longitudinal wedge member mounted to the underside of said flat section and extending from said rear wall to a point away from said front wall thereby defining a space for cooperatively housing the rear of the flat section of an abutting roof tile in front wherein said space allows said roof tile to snuggly house the rear portion of an abutting tile in front.

2. The roof tile set forth in claim 1 wherein said flange member extends upwardly and outwardly at an angle of approximately 45 degrees.

* * * * *